US006752081B2

(12) United States Patent
Callahan et al.

(10) Patent No.: US 6,752,081 B2
(45) Date of Patent: Jun. 22, 2004

(54) METHOD OF ADJUSTING DAMPENING-SOLUTION FEED IN AN OFFSET PRINTING PRESS

(75) Inventors: Martin John Callahan, Dover, NH (US); Wolfgang Schönberger, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 63 days.

(21) Appl. No.: 10/237,538

(22) Filed: Sep. 9, 2002

(65) Prior Publication Data

US 2003/0047093 A1 Mar. 13, 2003

(30) Foreign Application Priority Data

Sep. 7, 2001 (DE) ..... 101 43 828

(51) Int. Cl.[7] ..... B41F 1/54

(52) U.S. Cl. ..... 101/484; 101/483; 101/147; 101/148; 101/450.1

(58) Field of Search ..... 101/484, 485, 101/486, 483, 147, 148, 349.1, 350.1, 350.4, 350.6, 364–367, 450.1; 422/66, 105, 108

(56) References Cited

U.S. PATENT DOCUMENTS

| | | | | | |
|---|---|---|---|---|---|
| 5,046,418 | A | * | 9/1991 | Koehler et al. | 101/148 |
| 5,341,734 | A | * | 8/1994 | Jeschke et al. | 101/148 |
| 5,355,796 | A | * | 10/1994 | Kobler et al. | 101/148 |
| 5,505,126 | A | * | 4/1996 | Ohno et al. | 101/147 |
| 5,592,880 | A | * | 1/1997 | Rodi | 101/450.1 |
| 5,907,999 | A | | 6/1999 | Lusar et al. | 101/484 |
| 6,138,563 | A | * | 10/2000 | Sone et al. | 101/147 |

FOREIGN PATENT DOCUMENTS

| | | | | |
|---|---|---|---|---|
| CH | 661 686 A5 | | 8/1987 | |
| DE | 36 11 645 C2 | | 10/1987 | |
| DE | 38 28 182 A1 | | 2/1990 | |
| DE | 197 20 954 A1 | | 12/1998 | |
| JP | 2000000953 A | * | 1/2000 | B41F/7/26 |

* cited by examiner

*Primary Examiner*—Minh H Chau
(74) *Attorney, Agent, or Firm*—Laurence A. Greenberg; Werner H. Stemer; Ralph E. Locher

(57) ABSTRACT

A method of adjusting dampening-solution feed of an offset printing press by a control device includes determining a required dampening-solution demand for a first calibration printing form with a known minimum percent area coverage and for a second calibration printing form with a known maximum percent area coverage at a calibration speed, and storing the dampening-solution demand in the control device as interpolation reference points; determining a percent area coverage lying between the maximum and the minimum percent area coverage of the calibration printing forms of a printing form to be used for a forthcoming print job, and passing the determined percent area coverage on to the control device; determining by the control device the dampening-solution demand required for the forthcoming print job with the printing form provided for the purpose at the calibration speed, by interpolating between the interpolation reference points; determining a printing-speed dependent characteristic curve of the dampening-solution demand required for the forthcoming print job with the printing form provided for the purpose; and controlling, during the processing of the print job, the feed of the dampening solution along the characteristic curve.

10 Claims, 2 Drawing Sheets

METHOD OF ADJUSTING DAMPENING-SOLUTION FEED IN AN OFFSET PRINTING PRESS

BACKGROUND OF THE INVENTION

Field of the Invention

The invention relates to a method of adjusting dampening-solution feed in an offset printing press by a control device.

Offset printing presses of the type mentioned herein comprise an inking unit and a dampening unit, which are preset before each new print job in order to minimize the start-up wastage, i.e., in order to obtain the first so-called good sheet as quickly as possible. In conventional inking units, zone presetting is often performed, wherein, during a changeover of the press, the zones are opened wide at locations whereat, depending upon the subject, more ink is picked up. In the areas wherein many nonprinting locations appear on the printing form and, therefore, only little ink is required, the zones are only slightly opened.

With regard to short inking units, such as anilox inking units, this zone presetting is omitted, because these inking units operate without zones and are completely free of ghosting. The ink density is accordingly correct from the start of the print job, irrespective of which printing form is put in place. In the case of such a short inking unit, only the dampening-solution feed has yet to be adjusted in wet offset. The start-up wastage therefore depends here upon how quickly the correct adjustment for the dampening-solution feed is found. The dampening-solution demand depends upon the subject and the type of paper. More dampening solution is required for printing forms with a high take-up of ink than for light printing forms with little ink take-up. Also, more dampening solution is required for uncoated paper than for coated paper.

In connection with the adjustment of dampening-solution feed in dampening units, characteristic curves, also known as run-up curves, are stored in a control device. The characteristic curves indicate the different dampening-solution demand at different speeds. It is thereby possible to accelerate the printing press after the first good sheet has been printed, the dampening-solution feed being adjusted along the respective characteristic curve.

In a method of adjusting the dampening-solution feed disclosed in the published German Patent Document DE 38 28 182 A1, presetting of the dampening unit is performed manually, i.e., by operating personnel, who change the dampening-solution feed during start-up of the printing operation until the first good sheet is obtained. Following this manual basic setting of the dampening-solution feed, which is performed at a low printing speed, the position of the characteristic curve is defined in a graph wherein the quantity of dampening solution is plotted against machine speed. If the printing speed is then increased, the control device adjusts the quantity of dampening solution required for the respective printing speed, which is to be fed in along the characteristic curve. A disadvantage of the heretofore known method is that adjustment of the dampening unit is performed only after start-up of the print job, the level of start-up wastage being dependent upon the empirical values and the technical knowledge of the operating personnel.

SUMMARY OF THE INVENTION

It is an object of the invention to provide a method of adjusting dampening-solution feed in an offset printing machine wherein a production of start-up wastage is reduced in comparison with heretofore known methods of this general type.

With the foregoing and other objects in view, there is provided, in accordance with the invention, a method of adjusting dampening-solution feed of an offset printing press by a control device, which comprises determining, in a first step, a required dampening-solution demand for a first calibration printing form with a known minimum percent area coverage and for a second calibration printing form with a known maximum percent area coverage at a calibration speed, and storing the dampening-solution demand in the control device as interpolation reference points; determining, in a second step, a percent area coverage lying between the maximum and the minimum percent area coverage of the calibration printing forms of a printing form to be used for a forthcoming print job, and passing the determined percent area coverage on to the control device; determining by the control device, in a third step, the dampening-solution demand required for the forthcoming print job with the printing form provided for the purpose at the calibration speed, by interpolating between the interpolation reference points; determining, in a fourth step, a printing-speed dependent characteristic curve of the dampening-solution demand required for the forthcoming print job with the printing form provided for the purpose; and controlling, in a fifth step, during the processing of the print job, the feed of the dampening solution along the characteristic curve.

In accordance with another mode, the method invention further comprises, in the first step, determining the required dampening-solution demand of the first calibration printing form and that of the second calibration printing form at calibration speed empirically.

In accordance with a further mode, the method invention further comprises, in the second step, determining the percent area coverage of the printing form to be used for the forthcoming print job by a plate scanner.

In accordance with an alternative mode, the method invention further comprises, in the second step, determining the percent area coverage of the printing form to be used for the forthcoming print job from image data from a prepress system.

In accordance with an added mode, the method invention further comprises, for a third calibration printing form with a known, mean percent area coverage, determining the respectively required dampening-solution demand at various printing speeds, and determining therefrom a characteristic reference curve.

In accordance with an additional mode, the method invention further comprises storing the characteristic reference curve in the control device.

In accordance with yet another mode of the method invention, the characteristic curve of the dampening-solution demand required for the forthcoming print job with the printing form provided for this purpose, and the characteristic reference curve are identical and run parallel to one another.

In accordance with yet a further mode, the method invention further comprises determining at least one further value of the dampening-solution demand at different print speeds for refining the characteristic reference curve.

In accordance with yet an added mode, the method invention further comprises, during production printing, finely adjusting manually the dampening-solution feed, starting from the characteristic curve, and storing in the control device the curve actually run during the print job and relating to the dampening-solution feed dependent upon the printing speed and the percent area coverage.

In accordance with a concomitant mode, the method invention further comprises, before the start of a subsequent print job, comparing the characteristic curve determined by the control device with the values of the curve previously actually run for the same percent area coverage.

For achieving the object of the invention, the method is distinguished by the fact that, first, the required dampening-solution demand is determined for a first calibration printing form with a known minimum percent area coverage and for a second calibration printing form with a known maximum percent area coverage at a calibration speed and is deposited in the control device as interpolation reference points. Then, the percent area coverage lying between the maximum and the minimum percent area coverage of the calibration printing forms, of a printing form to be used for a forthcoming print job is determined and passed on to the control device. In a third step, with the aid of the control device, the dampening-solution demand required at the calibration speed for the forthcoming print job with the printing form provided for the purpose is determined by interpolation between the interpolation reference points. In a fourth step, a printing-speed dependent characteristic curve of the dampening-solution demand required for the forthcoming print job with the printing form provided for the purpose is determined. Finally, in a fifth step, during the processing of the print job, the dampening-solution feed is controlled along the characteristic curve. Likewise, different curves are stored for different types of paper. Machine-finished papers require a great deal of dampening solution, coated papers need less dampening solution. The method offers the advantage that, with the aid of the control device, presetting of the dampening unit can be performed as a function of a subject and of the size of the ink-carrying area on the printing form, respectively. The dampening unit can therefore be adjusted even before the start of the printing operation so that, in particular, in short inking units, preferably no start-up wastage, but at least only relatively low start-up wastage occurs, in comparison with heretofore known methods of this general type. The first so-called good sheet is therefore obtained relatively quickly. The control device therefore calculates the starting adjustment or adjustments of the dampening unit and, during the processing of the print job, matches the dampening-solution feed to the respective printing speed. In the method according to the invention, therefore, the extent of start-up wastage does not depend upon the knowledge of the operating personnel, who at most intervene in the printing process for the purpose of making a fine adjustment.

Other features which are considered as characteristic for the invention are set forth in the appended claims.

Although the invention is illustrated and described herein as embodied in a method of adjusting damping-solution feed in an offset printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
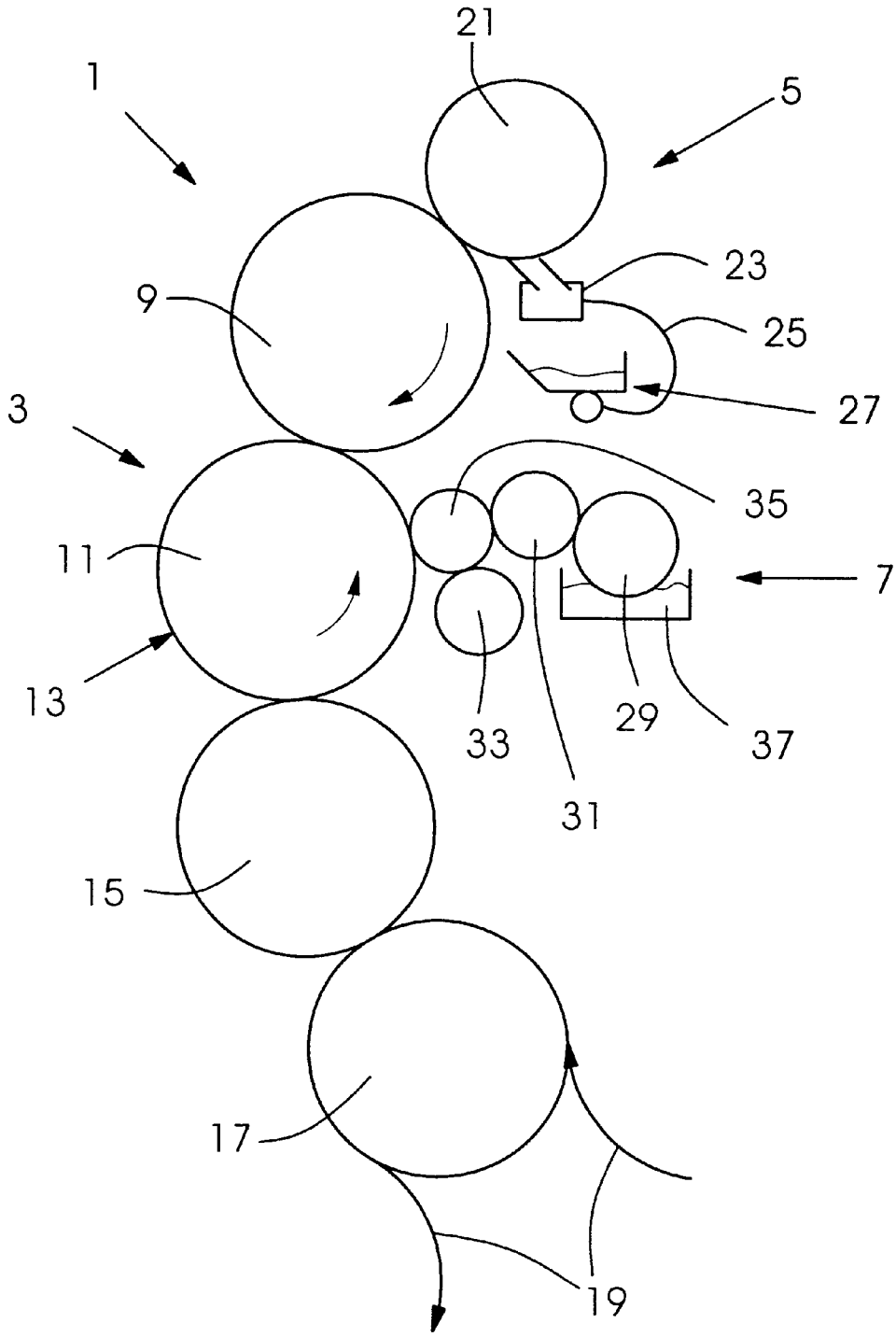
FIG. 1 is a fragmentary diagrammatic side elevational view of an exemplary embodiment of an offset printing machine.

Referring now to the drawings and, first, particularly to FIG. 1 thereof, there is shown therein, in a fragmentary diagrammatic view, an exemplary embodiment of an offset printing press 1, namely a printing unit 3, an inking unit 5 and a dampening unit 7. The construction and the function of the offset printing press 1 are generally known, so that only a brief description thereof is provided hereinafter.

The printing unit 3 comprises an ink applicator roller 9, a printing form 13 formed here by a plate cylinder 11, a blanket cylinder 15 and an impression cylinder 17, over which a non-illustrated printing material, such as a sheet or a web, is guided as indicated by arrows 19.

The inking unit 5 is constructed here as a so-called short inking unit and comprises a screen roller 21 which cooperates with the ink applicator roller 9. The screen roller 21 is provided with depressions over the circumference thereof, the depressions being formed as cells and/or grooves, for example, which are not illustrated in FIG. 1, and which can be filled with ink or varnish. The circumference of the screen roller 21 is doctored or squeezed off by a chambered doctor blade 23. Ink is supplied to the chambered doctor blade 23 by an ink duct or fountain 27 connected to the chambered doctor blade 23 by a line 25. The inking unit 5 is also known as an anilox inking unit, and the screen roller 21 as an anilox roller.

The dampening unit 7 comprises rollers 29, 31, 33 and 35 and a dampening solution reservoir 37. The dampening unit 7 serves for applying dampening solution, such as water with additives, for example, to the plate cylinder 11. The dampening solution serves for separating the printing and nonprinting parts on the plate cylinder 11. Because part of the dampening solution is used in the printing, while another part is vaporized, dampening solution must be infed continuously. The Dampening-solution feed, i.e., the quantity of dampening solution per unit time, depends upon the percent area coverage of the respective printing form and upon the printing/machine speed and must be adjusted very precisely because, when too much dampening solution is provided on the printing form 13, at least some of this solution gets into the inking unit 3 and can consequently disrupt the printing process and, when too little dampening solution is fed to the printing form 13, no separation between the printing and nonprinting parts on the printing form 13 can take place. So-called scumming occurs, i.e., the nonprinting parts also print.

The offset printing press 1 further comprises a control device, which is not illustrated in the figures, by the aid of which the adjustment of the dampening-solution feed is performed, as is described hereinafter with reference to FIGS. 2 to 4. The control device for the dampening-solution feed is preferably integrated into a control unit of the offset printing press 1 or, if necessary or desirable, coupled therewith.

Figure 2:
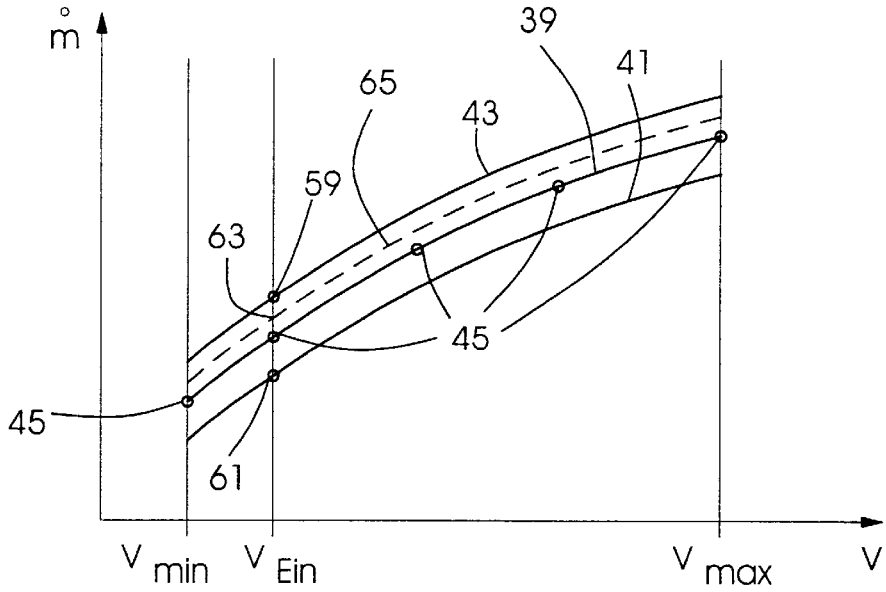
FIG. 2 is a graph or plot diagram wherein quantities of dampening solution per unit time is plotted against printing/machine speed.

FIG. 2 shows a graph or plot diagram wherein the printing/machine speed v is plotted on the x-axis against the quantity of dampening solution per unit time $\dot{m}$, for example liters per minute, to be fed to the printing form 13, which is plotted on the y-axis. Shown in the graph are a characteristic reference curve 39 and characteristic curves 41 and 43, which are also referred to as run-up curves. In this exemplary embodiment, the course of the curves 41 and 43 is identical to that of the reference curve 39, i.e., the curves 41 and 43 run exactly parallel to the reference curve 39. The reference curve 39 shows the respectively required Dampening-solution demand of a calibration printing form, which is not illustrated in the figures, with a conventional, mean percent area coverage at various printing speeds. The reference curve 39 has been determined at various printing speeds by using a plurality of reference points 45, of which only a few are illustrated in FIG. 2. The reference curve 39 is stored in the control device.

Between the curves 41 and 43 there extends an area wherein all of the reference points from all of the printing forms with different percent area coverages at all the machine speeds lying between the minimum machine speed $v_{min}$ and the maximum machine speed $v_{max}$ are located.

Figure 4:
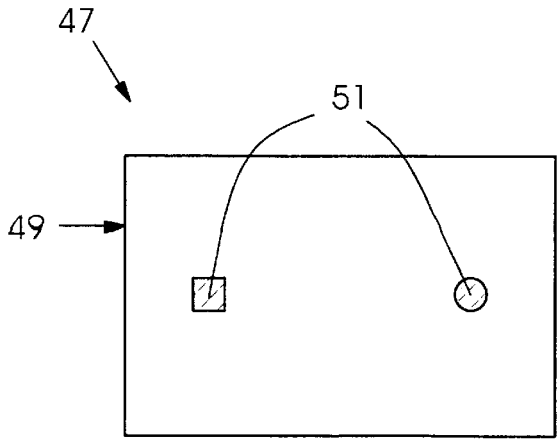
FIG. 4 is a plan view of an exemplary embodiment of a subject with a minimum percent area coverage.

FIG. 4 shows a section of a first calibration printing form 47, specifically a subject 49 which has a conventional, minimum percent area coverage. Accordingly, the proportion of the printing parts 51, which are indicated here as points, by way of example, exhibits a minimum when compared with the nonprinting parts, which are wetted by dampening solution. The "area coverage" and the "percent area coverage", respectively, therefore describes the ratio between the printing and the nonprinting parts of the printing form.

Figure 3:
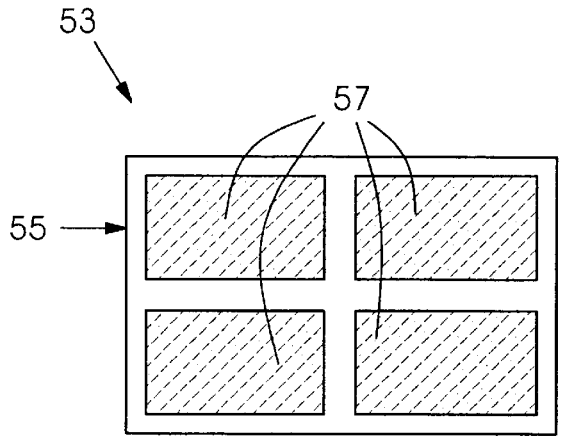
FIG. 3 is a plan view of an exemplary embodiment of a subject with a maximum percent area coverage.

FIG. 3 shows a section of a second calibration printing form 53, specifically a subject 55 which exhibits a conventional, maximum percent area coverage. The proportion of the printing parts 57 on the second calibration printing form 53, which are represented here as shaded or hatched rectangles, exhibits a maximum when compared with the nonprinting parts.

The required dampening-solution demand of the first calibration printing form and of the second calibration printing form at calibration speed is determined empirically in the preferred embodiment.

The percent area coverage of the third calibration printing form, by which the characteristic reference curve 39 is determined, therefore has a percent area coverage which lies approximately midway between the extreme values represented in FIGS. 3 and 4.

The method according to the invention for adjusting the dampening-solution feed provides, firstly, at a specific printing/machine speed, namely the calibration speed, which in the exemplary embodiment according to FIG. 2 corresponds to the set-up speed $V_{Ein}$, for the dampening-solution demand and/or the dampening-unit adjustment for the subjects 49 and 55 with a minimum and maximum percent area coverage, respectively, to be determined. These values serving as reference points 59 and 61 are plotted in the graph, the reference point 59 representing the first calibration printing form 47 with minimum percent area coverage and the reference point 61 representing the second calibration printing form 53 with maximum percent area coverage.

The reference points 59 and 61 are stored in the control device as interpolation reference points. As can be seen from the graph of FIG. 2, the characteristic curve 41 intersects the reference point 61, i.e., the curve 41 represents the run-up curve for a printing form with a maximum percent area coverage, while the characteristic curve 43 intersects the reference point 59 and is therefore the run-up curve for a printing form with a minimum percent area coverage.

In a next step, the percent area coverage lying between the maximum and minimum percent area coverages of the first and the second calibration printing forms 47 and 53 of a printing form to be used for a forthcoming print job, which is not illustrated in the figures, is determined and passed on to the control device. The percent area coverage of the printing form to be used for the forthcoming print job can be determined, for example, by a plate scanner or from the image data of a prepress system, i.e., the percent area coverage of the printing form and of the subject located thereon, respectively, can be obtained by scanning-in the printing form or directly from the image data of the prepress stage.

In the next step, with the aid of the control device, the dampening-solution demand required at calibration speed/set-up speed $v_{Ein}$ for the forthcoming print job with the printing form provided for the purpose is determined by interpolating between the interpolation reference points 59 and 61. The dampening-solution demand of this printing form at set-up speed $v_{Ein}$ is indicated in the graph as the point 63.

In a fourth step, a printing-speed dependent characteristic curve 65 of the dampening-solution demand required for the forthcoming print job with the printing form provided for the purpose is determined, as indicated by the broken line 65 in the graph of FIG. 2. In a preferred embodiment, provision is made for the characteristic curve 65 to be formed by shifting the reference curve 39 in parallel into the point 63, i.e., the course of the curve 65 and the course of the reference curve 39 are identical. The more accurate the reference curve 39 is, i.e., the more accurately it specifies the required optimum amount of dampening solution for the respective printing speed, the more precise is the characteristic curve 65. It is therefore possible, at each printing/machine speed v, for the respectively optimal quantity $\dot{m}$ of dampening solution to be fed to the plate cylinder 11, to be adjusted without requiring manual intervention for that purpose by the operating personnel.

The data determined from the aforedescribed four steps serve for presetting the dampening unit 5, i.e., the dampening-solution feed.

At the start of processing of the forthcoming print job, the printing speed can be relatively low and, for example, can correspond to the set-up speed $v_{Ein}$. If the printing speed v is then increased, the dampening-solution feed is controlled along the characteristic curve 65, which specifies a value for the amount of dampening solution for each printing speed.

The method according to the invention, which readily results from the foregoing explanations relating to FIGS. 1 to 4, is distinguished by the fact that presetting of the dampening unit 7 as a function of the printing form to be used for the forthcoming print job and as a function of the subject, respectively, is realizable so that, preferably, the first printed image already corresponds to the requirements, i.e., is not wastage. In any case, the presettings are already so accurate that, at the latest, immediately following the start-up of the print job, by manual adjustment on the part of the operating personnel, the characteristic curve 65 can be changed so quickly that the first so-called good sheet and, when printing a continuous web, the first good printed image, respectively, is present after a few revolutions of the rollers/cylinders. As a result, a relatively small amount of start-up wastage or spoiled sheets can be realized in comparison with that of heretofore known methods.

It is particularly advantageous if, in relation to the respectively stored percent area coverage, the actual characteristic curve which the operating personnel have ultimately run as a result of the fine adjustment thereof is also stored in the control device and evaluated in such a manner that before the next start and the next print job, respectively, the characteristic curves/run-up curves are continually compared with these values. As a result, the preset characteristic curves are able to be optimized automatically. Creeping displacements in the dampening unit 7 can thereby be compensated for automatically.

In the case of the exemplary embodiment described with respect to the figures, the curves 41, 43 and 65 were produced directly by parallel displacement of the reference curve 39.

In this exemplary embodiment, the reference curve 39 is a continuous curve which, for example, has been produced by extrapolation (mathematical function) or by determining a large number of reference points, which predefines or prescribes a new value for the amount of dampening solution to be infed for each machine-speed value. In connection with the invention here, the term "characteristic curve" or "reference curve" is also understood to mean a curve which predefines or prescribes a single value for the amount of dampening solution, respectively, for a preferably relatively narrow range of the machine speed. The transition of this curve from one speed range to another is therefore abrupt.

Provided that the dampening unit is constructed in such a manner that the dampening solution can be metered individually in a plurality of areas over the width of the printing material and the subject, respectively, such as in the case of a spray dampening unit having a plurality of nozzles arranged beside one another, these areas can be given different presettings for the dampening-solution feed. It is also possible here to provide a zonal presetting of the dampening-solution feed to the subject.

In the exemplary embodiment of the dampening unit illustrated in FIG. 1, the control of the dampening-solution feed can be carried out, for example, by adjusting or setting the rotational speed of at least one of the rollers of the dampening unit and changing that rotational speed, respectively, in accordance with the dampening-solution demand that is required.

The manner of respectively influencing and adjusting the dampening-solution feed depends upon the respective embodiment of the dampening unit which, as described hereinbefore, can be a contacting or contactless dampening unit.

It is common to all mode variations of the method that both a presetting or preadjustment of the dampening unit and an adaptation of the dampening-solution demand dependent upon the printing speed, which can be automated with the aid of the preferably electronic control device, are realizable.

We claim:

1. A method of adjusting dampening-solution feed of an offset printing press by a control device, which comprises determining, in a first step, a required dampening-solution demand for a first calibration printing form with a known minimum percent area coverage and for a second calibration printing form with a known maximum percent area coverage at a calibration speed, and storing the dampening-solution demand in the control device as interpolation reference points;

determining, in a second step, a percent area coverage lying between the maximum and the minimum percent area coverage of the calibration printing forms of a printing form to be used for a forthcoming print job, and passing the determined percent area coverage on to the control device;

determining by the control device, in a third step, the dampening-solution demand required for the forthcoming print job with the printing form provided for the purpose at the calibration speed, by interpolating between the interpolation reference points; determining, in a fourth step, a printing-speed dependent characteristic curve of the dampening-solution demand required for the forthcoming print job with the printing form provided for the purpose; and controlling, in a fifth step, during the processing of the print job, the feed of the dampening solution along the characteristic curve.

2. The method according to claim 1, which further comprises, in the first step, determining the required dampening-solution demand of the first calibration printing form and that of the second calibration printing form at calibration speed empirically.

3. The method according to claim 1, which further comprises, in the second step, determining the percent area coverage of the printing form to be used for the forthcoming print job by a plate scanner.

4. The method according to claim 1, which further comprises, in the second step, determining the percent area coverage of the printing form to be used for the forthcoming print job from image data from a prepress system.

5. The method according to claim 1, which further comprises, for a third calibration printing form with a known, mean percent area coverage, determining the respectively required dampening-solution demand at various printing speeds, and determining therefrom a characteristic reference curve.

6. The method according to claim 5, which further comprises storing the characteristic reference curve in the control device.

7. The method according to claim 5, wherein the characteristic curve of the dampening-solution demand required for the forthcoming print job with the printing form provided for this purpose, and the characteristic reference curve are identical and extend parallel to one another.

8. The method according to claim 5, which further comprises determining at least one further value of the dampening-solution demand at different print speeds for refining the characteristic reference curve.

9. The method according to claim 1, which further comprises, during production printing, finely adjusting manually the dampening-solution feed, starting from the characteristic curve, and storing in the control device the curve actually run during the print job and relating to the dampening-solution feed dependent upon the printing speed and the percent area coverage.

10. The method according to claim 9, which further comprises, before the start of a subsequent print job, comparing the characteristic curve determined by the control device with the values of the curve previously actually run for the same percent area coverage.

* * * * *